US006830016B2

(12) United States Patent
Kim

(10) Patent No.: US 6,830,016 B2
(45) Date of Patent: Dec. 14, 2004

(54) SYSTEM AND METHOD FOR COOLING AN ENGINE

(75) Inventor: Gyu-Hwan Kim, Suwon (KR)

(73) Assignee: Hyundai Motor Company, Seoul (KR)

( * ) Notice: Subject to any disclaimer, the term of this patent is extended or adjusted under 35 U.S.C. 154(b) by 9 days.

(21) Appl. No.: 10/305,550

(22) Filed: Nov. 27, 2002

(65) Prior Publication Data

US 2003/0111025 A1 Jun. 19, 2003

(30) Foreign Application Priority Data

Nov. 29, 2001 (KR) ..... 2001-0074793

(51) Int. Cl.[7] ..... F02F 1/10
(52) U.S. Cl. ..... 123/41.72
(58) Field of Search ..... 123/41.1, 41.29, 123/41.72, 41.08, 41.44, 41.02, 41.09

(56) References Cited

U.S. PATENT DOCUMENTS 4,369,738 A * 1/1983 Hirayama ..... 123/41.1
4,726,325 A * 2/1988 Itakura ..... 123/41.1
4,759,316 A * 7/1988 Itakura ..... 123/41.08

FOREIGN PATENT DOCUMENTS

GB 2245703 A * 1/1992 ..... F01P/3/02
JP 57148018 A * 9/1982 ..... F01P/7/16

* cited by examiner

*Primary Examiner*—Tony M. Argenbright
*Assistant Examiner*—Hyder Ali

(57) ABSTRACT

An engine is provided having a cylinder head and a cylinder block. The cylinder head has a head water-jacket for circulating coolant, and the cylinder block has a block water-jacket for circulating the coolant. Coolant flow is blocked between the block and head water-jackets except through a primary pathway or an additional one or more secondary pathways. First and second thermostats are equipped to respectively control coolant flow from the head and block water-jackets, such that the coolant flow through the head and block water-jackets are respectively controlled based on respectively preset temperatures of the first and second thermostats.

12 Claims, 9 Drawing Sheets

SYSTEM AND METHOD FOR COOLING AN ENGINE

FIELD OF THE INVENTION

The present invention relates to a system and method for cooling an engine, and more particularly, to a system and method for cooling an engine by separately cooling an engine's cylinder block and cylinder head.

BACKGROUND OF THE INVENTION

An internal combustion engine produces power by burning fuel in air. Accordingly, such engines are typically provided with cooling systems to radiate heat produced during the combustion away from the engine. Two types of cooling systems are widely used, namely, water-cooled systems and an air-cooled systems. Air-cooled systems cool the engine by flow of air, while water-cooled systems cool the engine by forcing coolant through the engine.

FIG. 1 shows a typical construction of a water-cooled system.

An engine 100 includes a cylinder head 110 and a cylinder block 120, where the cylinder head 110 and the cylinder block 120 respectively have first and second water-jackets 115 and 125. The first and second water-jackets 115 and 125 are connected and open to each other such that cylinders (not shown) and combustion chambers (not shown) are enclosed by the first and second water jackets 115 and 125. The first and second water-jackets 115 and 125 are usually collectively called the water-jacket.

A water-cooled cooling system includes a radiator 150 for cooling the coolant. Hot coolant is supplied from the water-jackets 115 and 125 to the radiator 150 through a high-temperature coolant line 130. The coolant, once cooled at the radiator 150, returns to the engine 100 through a low-temperature coolant line 140. A hydraulic pump 160 for generating such coolant flow is provided at a portion of the engine 100.

When the engine 100 is initially started, the coolant does not have to be cooled because its temperature is low. In fact, the coolant flow is generally blocked to quickly increase the coolant temperature. For this reason, a thermostat 170 is provided at a predetermined position in one of the high-temperature coolant line 130 and the low-temperature coolant line 140. The thermostat 170 opens the coolant line when the coolant temperature is above a predetermined temperature, and closes the coolant line when the coolant temperature is below the predetermined temperature. As shown in FIG. 1, the thermostat 170 can be disposed along either the high-temperature coolant line 130 or the low-temperature coolant line 140, at either end of the engine, such as at point A or B.

Furthermore, such a coolant circulation system typically includes a heater 180 for radiating heat into the interior of a vehicle. This heater 180 radiates heat of the coolant, supplied through the high-temperature coolant line 130, into the interior of the vehicle. In order to quickly radiate heat, a heater supply-line 185, for supplying coolant to the heater 180, is connected to the high-temperature coolant line 130 or to the cylinder head 110 (as shown). Where the thermostat 170 is disposed at the high-temperature coolant line 130, the heater supply-line 185 is connected to either the cylinder head 110, or between the engine and the thermostat 170. Where the thermostat 170 is disposed at the low-temperature coolant line 140, the heater supply-line 175 may be connected elsewhere.

Coolant is also supplied to a throttle body 190 that includes a throttle valve. The connection of a throttle body supply-line 195 for supplying coolant to the throttle body 190 is similar to the connection of the heater supply-line 185 described above.

In use, when the engine 100 is cool, the thermostat 170 closes the low-temperature coolant line 140 such that coolant flow to the radiator 150 is blocked. Accordingly the coolant circulates in the first and second water-jackets 115 and 125, the heater 180, and the throttle body 190 as shown by dotted arrows in FIG. 1. Once the engine 100 has warmed up such that the coolant temperature becomes a predetermined temperature (usually preset in the range of 82° C. and 88° C.), the thermostat 170 is opened such that the coolant can circulate through the radiator 150 as shown by solid arrows in FIG. 1. Because the cylinder head 110 is exposed to more heat than any other part in the internal combustion engine, more heat is conducted and radiated through the cylinder head 110. While the engine is warming up, coolant flows through the heater 180 and the throttle body 190. However, such coolant flows through the cylinder block 120, as well as the cylinder head 110, and accordingly heating efficiency to the interior of a vehicle is deteriorated. Furthermore, the warm-up period is lengthened.

In addition, during the warm-up period where the engine 100 is below a normal operating temperature, a catalytic converter, used for emission-control, does not sufficiently function to reduce noxious gas. Therefore, if the warm-up period is reduced, noxious exhaust gas may be reduced.

Furthermore, fuel consumption is increased during the warm-up period because lubricant temperature is low and its viscosity is high such that friction of mechanical parts of the engine 100 is high. Therefore, if the warm-up period is reduced, fuel consumption may also be lowered.

What is more, when the engine is warmed up to a normal operating temperature, the cylinder head 110 is exposed to substantially large amounts of heat. Therefore, heat from the cylinder head 110 should be more efficiently radiated. Furthermore, a cooling system and method of an engine should be preferably enhanced to reflect engine load, as radiation of heat is dependent on whether the engine load is high or low.

SUMMARY OF THE INVENTION

Embodiments of the present invention provide systems and methods for cooling an engine where a cylinder block and cylinder head are separately cooled. It should be appreciated that a "thermostat" as used here includes any device that acts as a valve, which is open at a temperature above a predetermined temperature, and closed at a temperature below the predetermined temperature. Also, a "water-jacket" as used herein includes any kind of passage with any shape, for enabling flow of coolant.

The cooling systems described herein are preferably used for cooling an engine. The engine preferably includes a cylinder head and a cylinder block. The cylinder head includes a head water-jacket for circulating coolant, while the cylinder block includes a block water-jacket for circulating the coolant. An exemplary cooling system also preferably includes a radiator for cooling the coolant, a high-temperature coolant line for supplying the coolant from the cylinder head to the radiator, a low-temperature coolant line for supplying the coolant from the radiator to at least one of the head and block water-jackets, a first thermostat disposed at a predetermined position in either the low-temperature coolant line or the high-temperature coolant line, a branch coolant line for supplying the coolant from the block water-jacket to the high-temperature coolant line, a second thermostat disposed at the branch coolant line, and a hydraulic pump for generating coolant flow in the coolant lines. The head and block water-jackets communicate with each other via a primary pathway for transporting the coolant therebetween. Also, coolant flow is blocked within a cylinder-region, where the cylinder region is a region between the primary pathway and the branch coolant line.

The low-temperature coolant line preferably supplies the coolant to the block water-jacket. A bypass flow-line for bypassing the second thermostat is preferably formed at the branch coolant line and/or the second thermostat.

A flow-rate of the second thermostat is preferably smaller than a flow-rate of the first thermostat by a predetermined ratio. More specifically, the predetermined ratio is preferably preset such that the ratio of coolant flow passing through the head water-jacket and the block water-jacket lies within a range of 7:3 to 5:5.

The primary pathway is preferably formed near a circumference of a cylinder distal from where the coolant is exhausted from the head water-jacket to the high-temperature coolant line. Within the cylinder-region, at least one air hole is preferably formed between the head water-jacket and the block water-jacket. A secondary pathway is preferably provided for transporting the coolant between the head and block water-jackets. This secondary pathway is found at a more distal portion than the primary pathway from where the coolant is exhausted from the head water-jacket to the high-temperature coolant line. Where the first thermostat is disposed at the high-temperature coolant line, the branch coolant line connects the block water-jacket to the high temperature coolant line at a predetermined portion located toward the engine from the first thermostat. Where the low-temperature coolant line is connected to the branch coolant line, the low-temperature coolant line comprises a first low-temperature coolant line from the radiator to the branch coolant line and a second low-temperature coolant line from the branch coolant line to the hydraulic-pump. In this embodiment, the first thermostat, preferably disposed between the first low-temperature coolant line and the branch coolant line, comprises a main valve and a bypass valve being cooperatively connected. The second low-temperature coolant line is branched between the main valve and the bypass valve.

An exemplary cooling method according to an embodiment of the present invention includes determining if a coolant temperature in the head water-jacket is above a first predetermined temperature. The coolant in the head water-jacket is then supplied to a radiator when the coolant temperature in the head water-jacket is above the first predetermined temperature. It is then determined if a coolant temperature in the block water-jacket is above a second predetermined temperature. The coolant in the block water-jacket is supplied to a radiator when the coolant temperature in the block water-jacket is above the second predetermined temperature. The second predetermined temperature is preferably preset higher than the first predetermined temperature. When the coolant temperature in the block water-jacket is not above the second predetermined temperature, the coolant in the block water-jacket is preferably supplied to the radiator in a smaller amount than that supplied from the head water-jacket to the radiator when the coolant temperature in the head water-jacket is above the first predetermined temperature.

BRIEF DESCRIPTION OF THE DRAWINGS

The accompanying drawings, which are incorporated in and constitute a part of the specification, illustrate an embodiment of the invention, and, together with the description, serve to explain the principles of the invention, where.

A preferred embodiment of the present invention will hereinafter be described in detail with reference to the accompanying drawings.

DETAILED DESCRIPTION OF THE PREFERRED EMBODIMENTS

Figure 2:
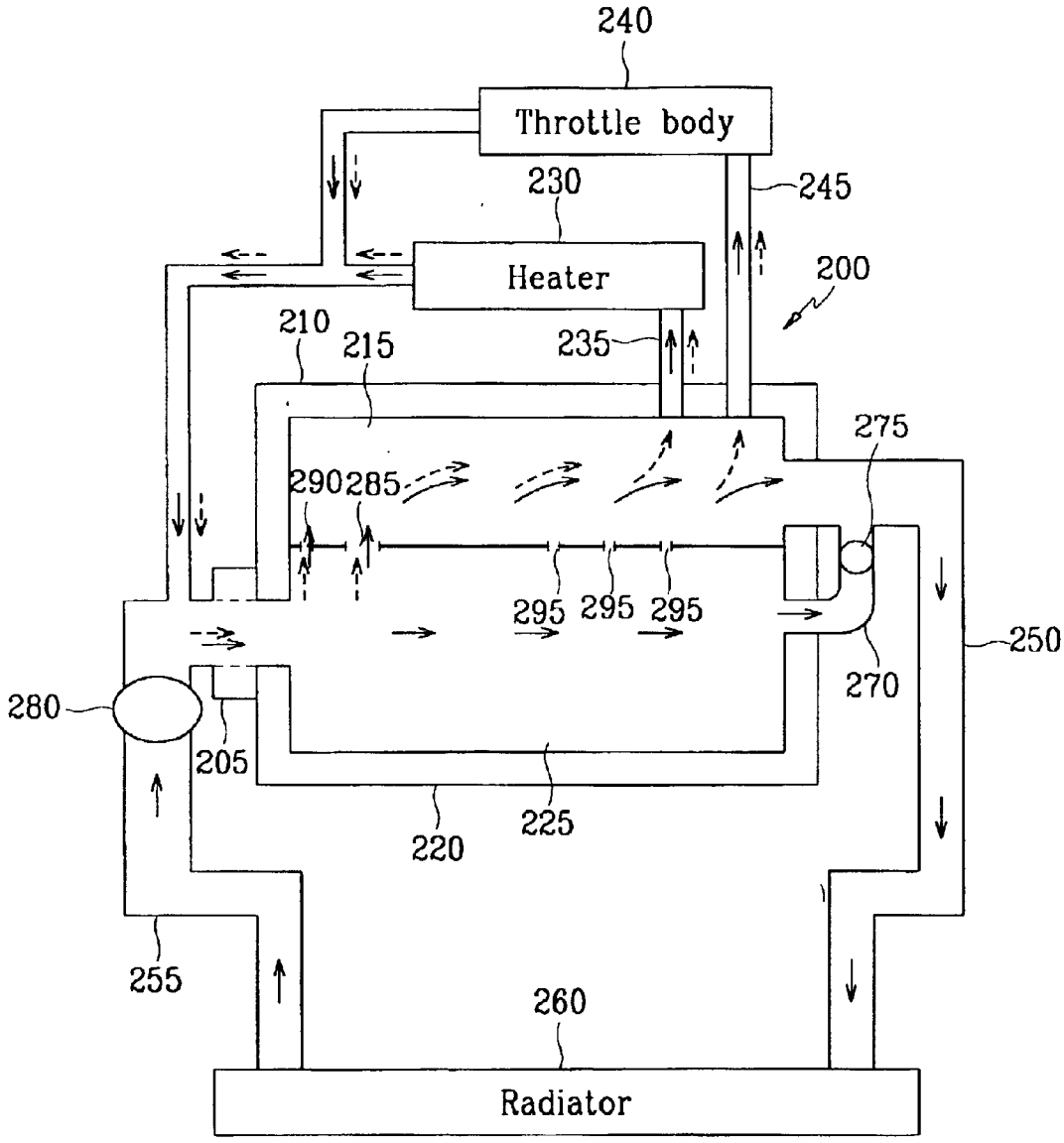
FIG. 2 is a schematic view of a first preferred embodiment of a cooling system of an engine according to the present invention.

As shown in FIG. 2, a preferred embodiment of the cooling system of the present invention is for cooling an engine 200 including a cylinder head 210 and a cylinder block 220. The cylinder head 210 has a head water-jacket 215 for circulating coolant, and the cylinder block 220 has a block water jacket 225 for circulating the coolant.

The preferred embodiment of the cooling system also includes a radiator 260 for cooling the coolant. a high-temperature coolant line 250 for supplying the coolant from the head water-jacket 215 to the radiator 260, a low-temperature coolant line 255 for supplying the coolant from the radiator 260 to at least one of the head and block water-jackets 215 and 225, a first thermostat 280 disposed at a predetermined position in the low-temperature coolant line 255 and/or the high-temperature coolant line 250, a branch coolant line 270 for supplying the coolant from the block water-jacket 225 to the high-temperature coolant line 250, and a second thermostat 275 disposed at the branch coolant line 270.

A primary pathway 285 is formed between the head and block water-jackets 215 and 225 for transporting the coolant therebetween. Coolant flow is blocked within a cylinder-region when the cylinder region is defined as a region between the primary pathway 285 and the branch coolant line 270.

The coolant used is preferably water, as is conventionally used. Accordingly, a water-pump 205 for generating coolant flow in the coolant lines is disposed at a portion of the engine 200. It should appreciated, however, that any coolant may be used, and the water-pump 205 will pump the coolant being used. Within the cylinder-region, at least one air hole 295 is preferably formed between the head water-jacket 215 and the block water-jacket 225 such that coolant can be easily refilled. The first thermostat 280 is disposed near the water-pump 205 end of the low-temperature coolant line 255.

A flow-rate of the second thermostat 275 is preferably preset to be smaller than a flow-rate of the first thermostat 280, by a predetermined ratio. The predetermined ratio is preferably within a range of 7:3 to 5:5, to facilitate a greater amount of coolant circulation through the cylinder head 210 than through the cylinder block 220. This is beneficial, as the cylinder head 210 is exposed to the majority of the heat produced by the engine 200.

Both a heater supply-line 235 for supplying the coolant to a heater 230 disposed within a vehicle, and a throttle body supply-line 245 for supplying the coolant to a throttle body 240, can be connected to the head water-jacket 210 and/or the high-temperature coolant line 250.

In use, the coolant from the heater 230 and the throttle body 240 returns to the water-pump 205 without passing though the first thermostat 280. However, a heat-detection portion (e.g. wax-containing portion of a wax-pellet type thermostat) of the first thermostat 280 is disposed toward the water-pump 205, such that coolant from the heater 230 and the throttle body 240 passes the heat-detection portion. Accordingly, the first thermostat 280 operates based on the coolant temperature of the head water-jacket 215.

When the thermostat 280 is closed, coolant circulation is blocked from the engine 200 to the water-pump 205 via the radiator 260. Therefore, the coolant moves from the water-pump 205 to the block water-jacket 225, from the block water-jacket 225 to the head water-jacket 215 through the primary pathway 285, from the head water-jacket 215 to the heater 230 and the throttle body 240, and from the heater 230 and the throttle body 240 back to the water-pump 205. The second thermostat 275 is also closed. Therefore, coolant flow is blocked within the cylinder-region of from the primary pathway 285 to the branch coolant line 270. Coolant is transported to the head water-jacket 215 through the primary pathway 285. Therefore, the warm-up period of an engine is reduced because the coolant flow in the block water-jacket 225 of the cylinder block 220 is minimized when the engine 200 is warming up.

Furthermore, the heater 230 and the throttle body 240 are supplied with coolant from the cylinder head 210 or the high-temperature coolant line 250 in which the coolant temperature increases more rapidly during warm-up of the 200. Therefore, the heater 230 can radiate heat more rapidly once the engine 200 has been started.

In order to more homogeneously cool the cylinder head 210, a secondary pathway 290 is preferably formed to produce auxiliary coolant flow between the block water-jacket 225 and the head water-jacket 215. In this embodiment, the secondary pathway 290 is preferably formed at a more distal portion from where the coolant is exhausted from the head water-jacket to the high-temperature coolant line than the primary pathway 285.

Figure 3:
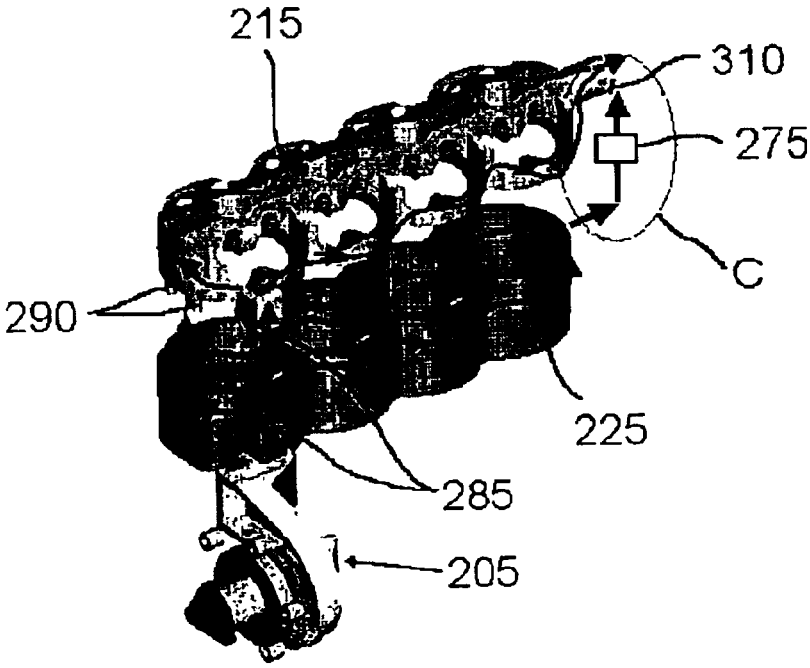
FIG. 3 shows an exemplary head water-jacket formed at a cylinder head, and block water-jacket formed at a cylinder block, and the relationship between the head and block water-jackets, hydraulic pump, and a second thermostat, according to a first preferred embodiment of the present invention as shown in FIG. 2.

FIG. 3 illustrates an exemplary 3-dimensional head water-jacket 215 formed at the cylinder head 210, and a block water-jacket 225 formed at the cylinder block 220. FIG. 3 also shows the relationship of the head and block water-jackets 215 and 225, the water-pump 205, and the second thermostat 275 to one another.

Figure 4:
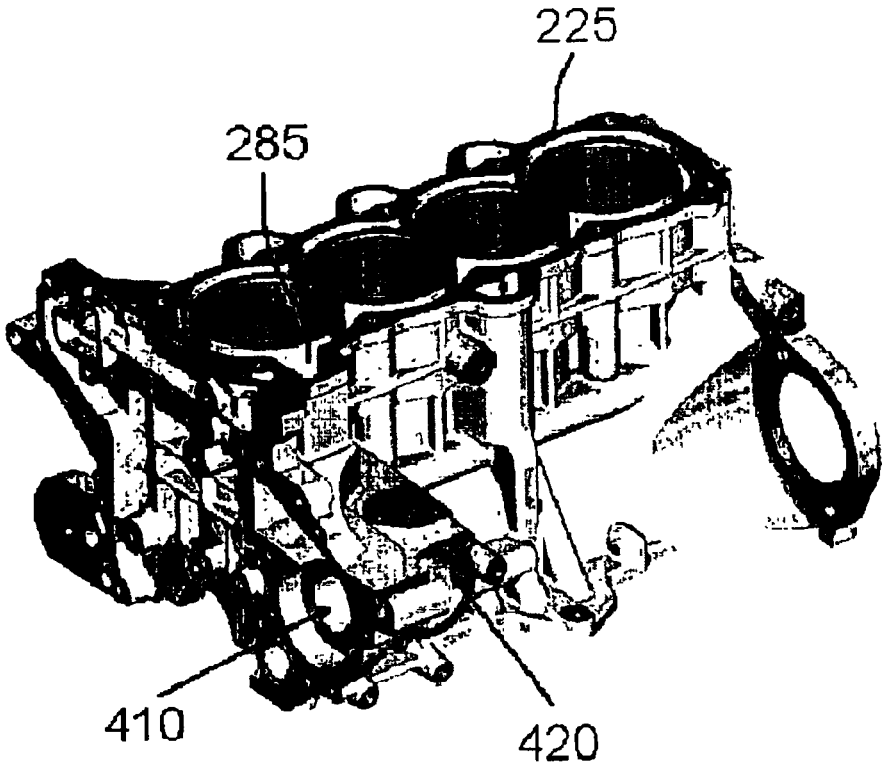
FIG. 4 is a perspective view of an exemplary cylinder block, according to a preferred embodiment of the present invention.

FIG. 4 illustrates an exemplary cylinder block 220 according to preferred embodiments of the present invention.

As shown in FIG. 3, the coolant supplied from the water-pump 205 is supplied to the head water-jacket 215 through the primary pathway 285 via the block water-jacket 225 formed at the cylinder block 220. The coolant supplied to the head water-jacket 215 flows as shown by solid arrows, and proceeds to an exhaust port 310. The primary pathway 285 is preferably formed near a circumference of a cylinder, distal from the exhaust port 310. The coolant is exhausted from the head water-jacket 215 to the high-temperature coolant line 250 such that coolant uniformly flows through the entire head water-jacket 215. The secondary pathway 290 is further preferably formed for uniform coolant flow.

When the second thermostat 275 is open, as shown in FIG. 2, the coolant flows in the block water-jacket 225 as well as in the head water-jacket 215 as shown by solid arrows, and is exhausted to the exhaust port 310 through the second thermostat 275. The water-pump 205 and the first thermostat 280 are disposed near the cylinder block 220. The block water-jacket 225 and the primary pathway 285 configurations are related to the shape of the cylinder block 220. The interrelationships are more obviously understood with reference to FIG. 4 where a water-pump mounting position 410 and a first thermostat mounting position 420 are indicated. Also shown is an exemplary physical relationship of the primary pathway 285 and the block water-jacket 225.

Figure 5:
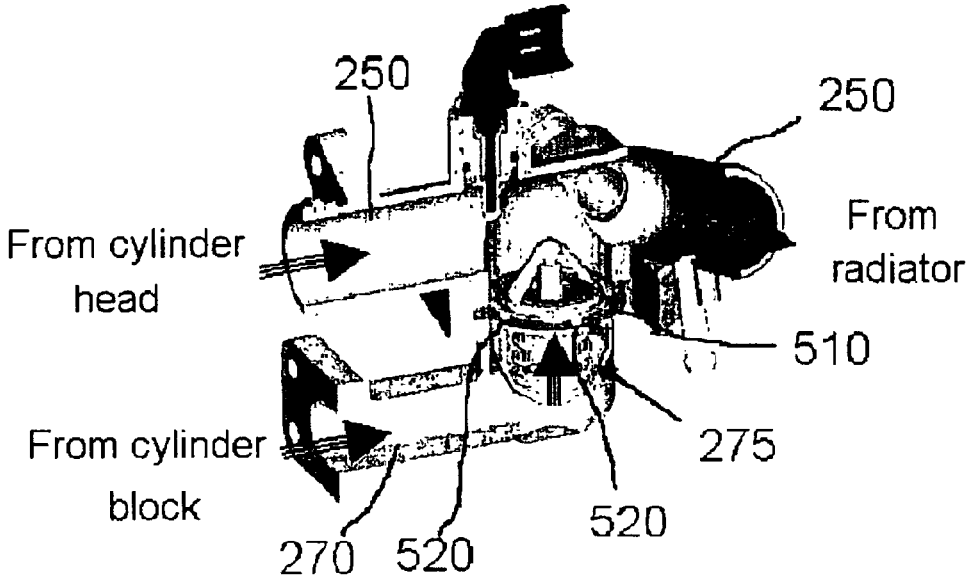
FIG. 5 is a detailed schematic view of area C in FIG. 3, and shows the relationships between the high-temperature coolant line, branch coolant line, and the second thermostat, according to the a preferred embodiment of the present invention shown in FIGS. 2 and 3.

FIG. 5 is a detailed schematic view of area C in FIG. 3. FIG. 5 also shows the relationship of the high-temperature coolant line 250, branch coolant line 270, and the second thermostat 275.

The branch coolant line 270 is formed, as shown in FIG. 5, for supplying the coolant from the block water-jacket 225 (FIG. 2) to the high-temperature coolant line 250. The second thermostat 275 is preferably disposed along the branch coolant line 270. In order to induce at least a minimal flow in the block water-jacket 225 (FIG. 2) even when the second thermostat 275 is closed, and accordingly to prevent hot spots on cylinder walls and to make the second thermostat 275 operate more sensitively, a bypass flow-line for bypassing the second thermostat is preferably formed at the branch coolant line 270 and/or the second thermostat 275. The second thermostat 275 has a frame 510, similar to a conventional thermostat. A plurality of passing holes 520 are formed on the frame 510 such that a small amount of coolant can bypass the second thermostat 275 even when the second thermostat 275 is fully closed. The amount of coolant bypassing through the passing holes 520 is preferably preset to about 10% of the amount of coolant that flows to the high-temperature coolant-line 250 from both the head and block water-jackets 215 (FIG. 2) and 225 (FIG. 2) when the second thermostat 275 is closed.

The relationship for assembling the cylinder head 210 and cylinder block 220 interposing the gasket 630 is clearly understood with reference to FIG. 6.

Figure 6A:
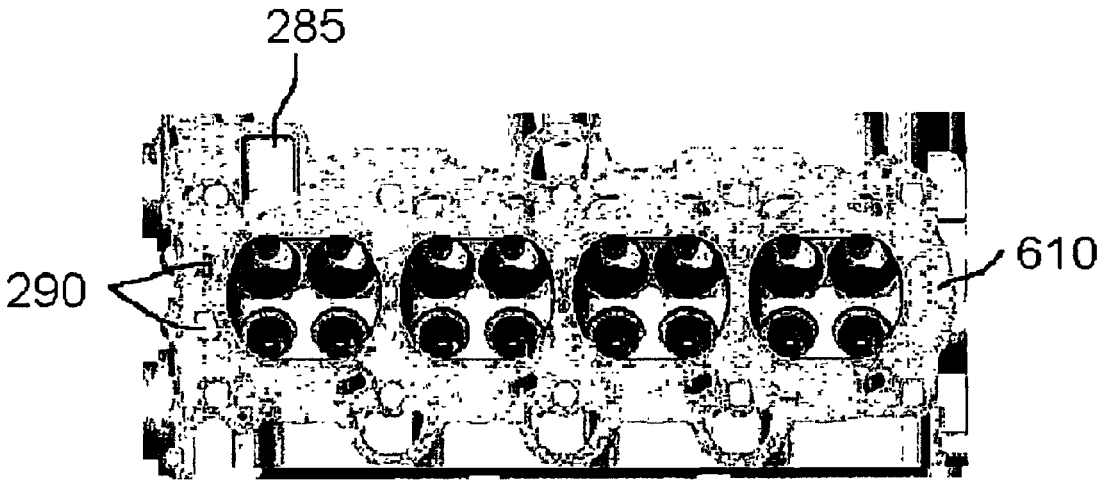
FIGS. 6*a*, 6*b*, and 6*c* cooperatively show the relationships between the cylinder head (FIG. 6*a*), cylinder block (FIG. 6*c*), and a gasket (FIG. 6*b*) used therebetween, according to a preferred embodiment of the present invention.
Figure 6B:
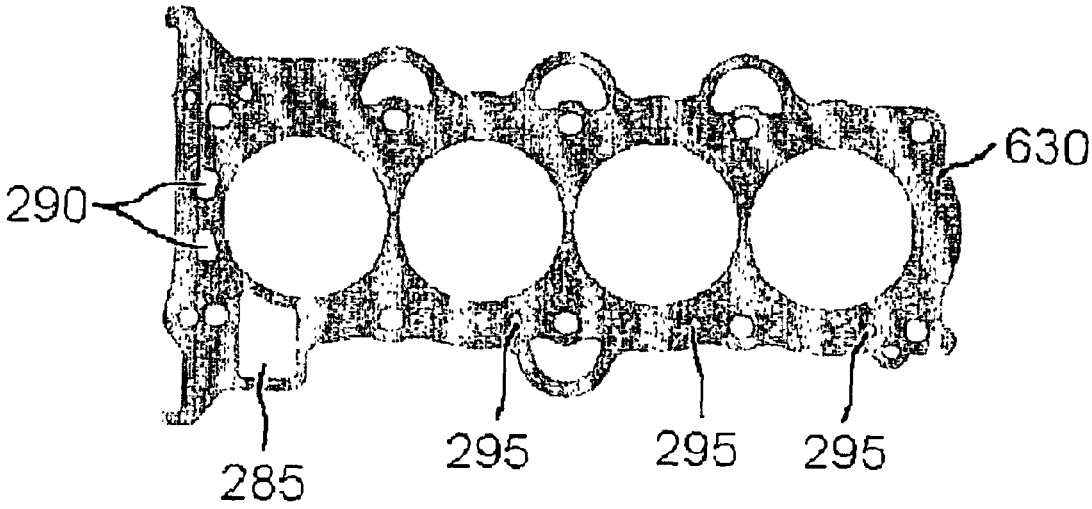
Figure 6C:
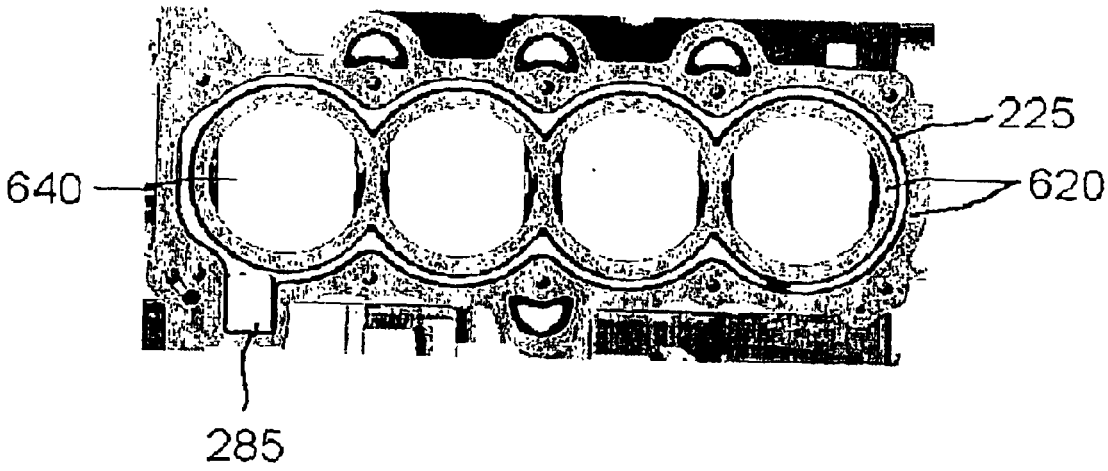

FIGS. 6*a*, 6*b*, and 6*c* cooperatively show the relationship of the cylinder head 210, the cylinder block 220, and a gasket 630 used therebetween, according to preferred embodiments of the present invention.

FIG. 6*a* shows a cylinder head side junction plane 610 to be joined to the cylinder block 220. FIG. 6*c* shows a cylinder block side junction plane 620 to be joined to the cylinder head 210. (Between the junction planes 610 and 620) The gasket 630 as shown in FIG. 6*b* is interposed in order to seal the junction.

As shown in FIGS. 6*a* through 6*c*, the primary pathway 285 is formed near a circumference of a cylinder 640 distal from where the coolant is exhausted from the head water-jacket 215 to the high-temperature coolant line 250. The secondary pathway 290 for transporting the coolant between the head and block water-jackets 215 and 225 is further formed therebetween, at a more distal position than the primary pathway 285, from where the coolant is exhausted from the head water-jacket 215 to the high-temperature coolant line 250. Within the cylinder-region, at least one air hole 295 is formed between the head water-jacket 215 and the block water-jacket 225.

Figure 7:
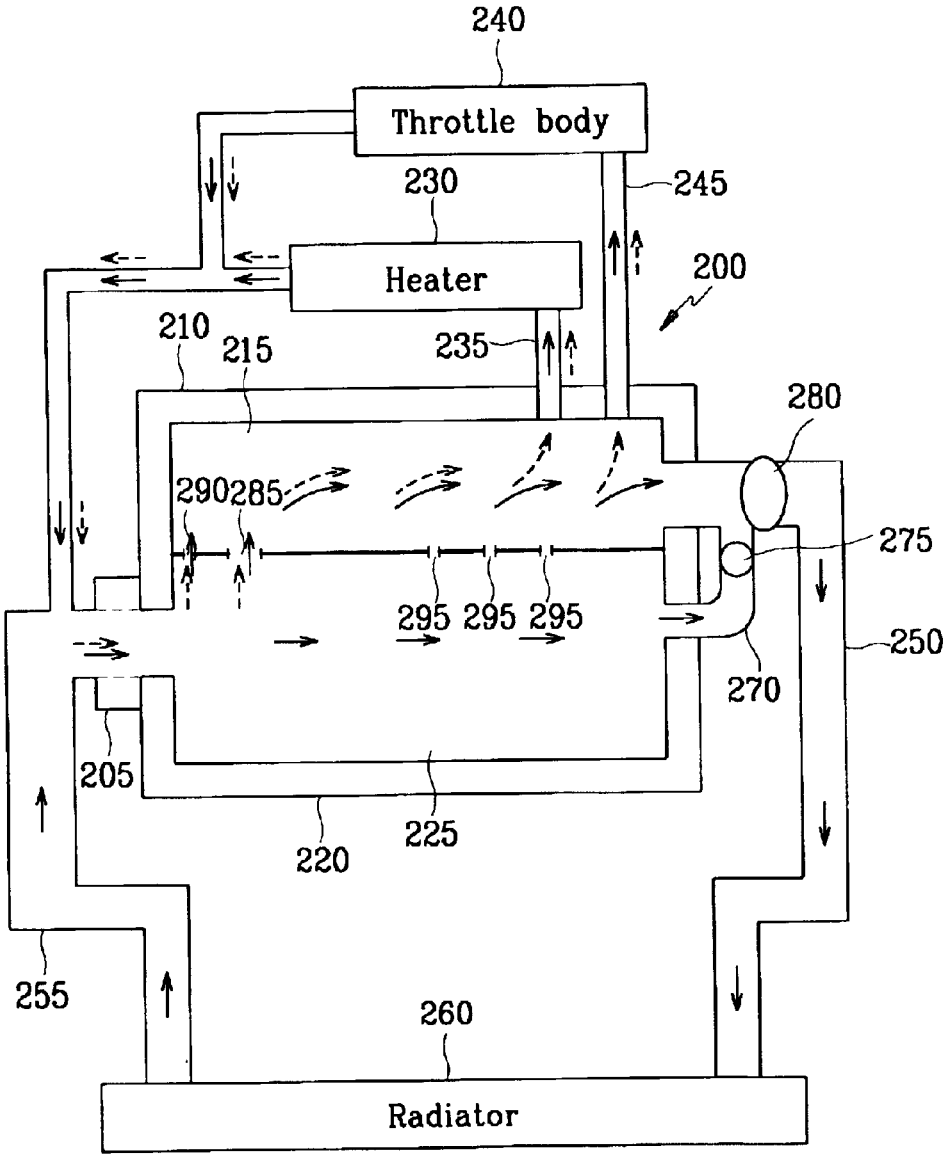
FIG. 7 is a schematic view of a second preferred embodiment of a cooling system of an engine, according to another embodiment of the present invention.

With reference to FIG. 7, this embodiment of the invention is similar to the above described embodiment, but it differs in that the first thermostat 280 is disposed at the high-temperature coolant line 250. The branch coolant line 270 preferably connects the block water-jacket 225 to the high-temperature coolant line 250 near the first thermostat 280. According to this layout, when the first thermostat 280 is closed, the coolant does not flow into the radiator even if the second thermostat 275 is open.

Figure 8:
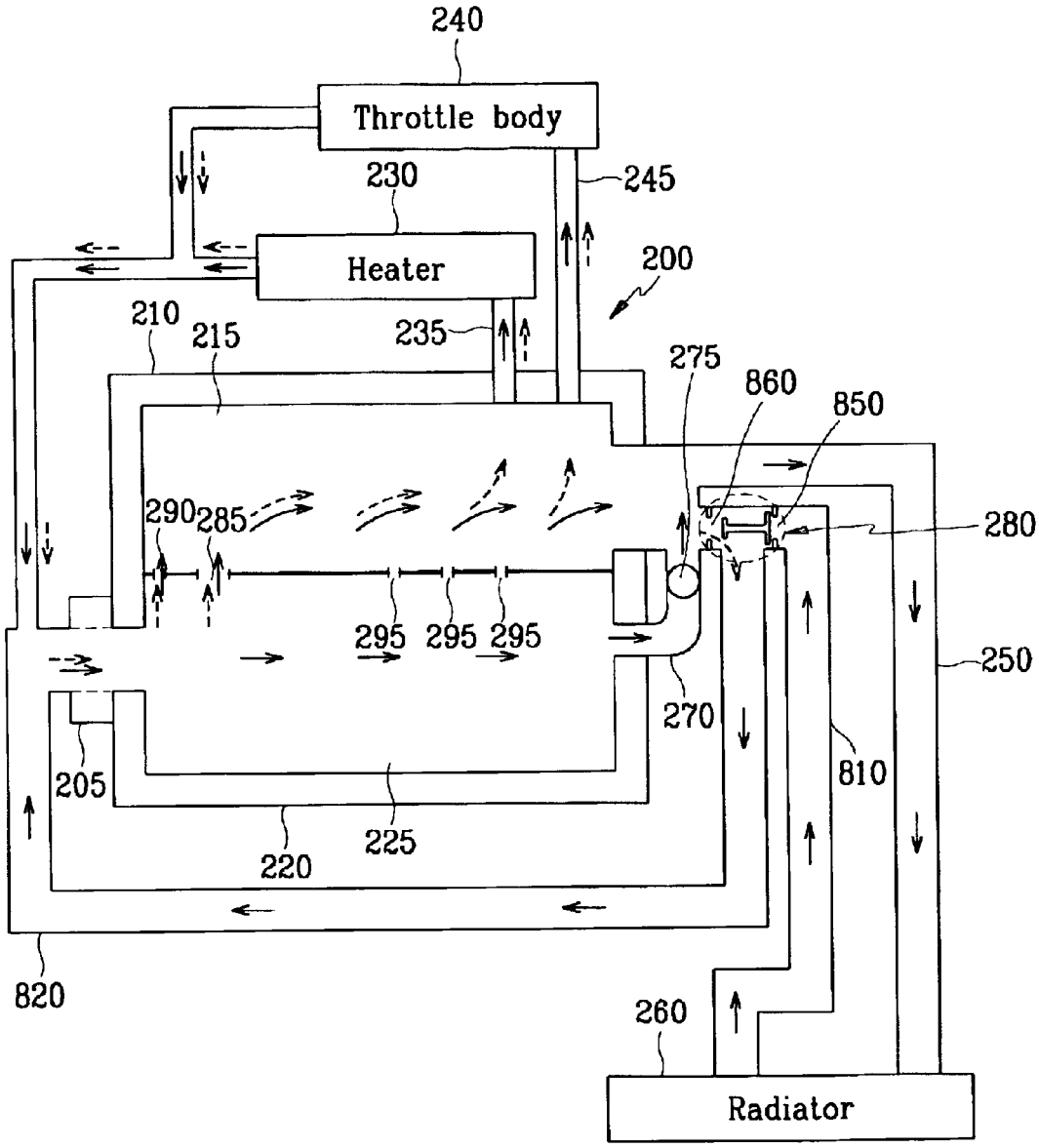
FIG. 8 is a schematic view of yet another preferred embodiment of a cooling system of an engine, according to yet another embodiment of the present invention.

With reference to FIG. 8, this embodiment of the invention is also similar to the first embodiment, but it differs in that the low-temperature coolant line 255 is connected to the branch coolant line 270, and the location and function of the first thermostat 280 are also different from the first embodiment. The low-temperature coolant line 255 is connected to the branch coolant line 270, such that the low-temperature coolant line 255 is divided into a first low-temperature coolant line 810 from the radiator 260 to the branch coolant line 270 and a second low-temperature coolant line 820 from the branch coolant line 270 to the water-pump 205.

The first thermostat 280, disposed between the first low-temperature coolant line 810 and the branch coolant line 270, comprises a main valve 850 and a bypass valve 860, the main and bypass valves 850 and 860 being cooperatively connected. The second low-temperature coolant line 820 is preferably branched between the main valve 850 and the bypass valve 860. A variety of configurations of such thermostats having the main and bypass valves 850 and 860 are well known to those skilled in the art (e.g., for a wax-pellet type thermostat, the two valves are connected to a reciprocating piston). When the first thermostat 280 is closed, and accordingly when the main valve 850 is closed and the bypass valve 860 is open, a small amount of the coolant in the head water-jacket 215 can circulate to the water-pump through the bypass valve 860. This coolant flow enables the first thermostat 280 to sense the heat of the coolant in the head water-jacket 215.

When the first thermostat 280 is open, and accordingly when the main valve 850 is open and the bypass valve 860 is closed, the coolant in the head water-jacket 215 does not circulate through the bypass valve 860, but rather it is supplied to the radiator 260 through the high-temperature coolant line 250 and returns to the water-pump 250 via the main valve 850.

Figure 1:
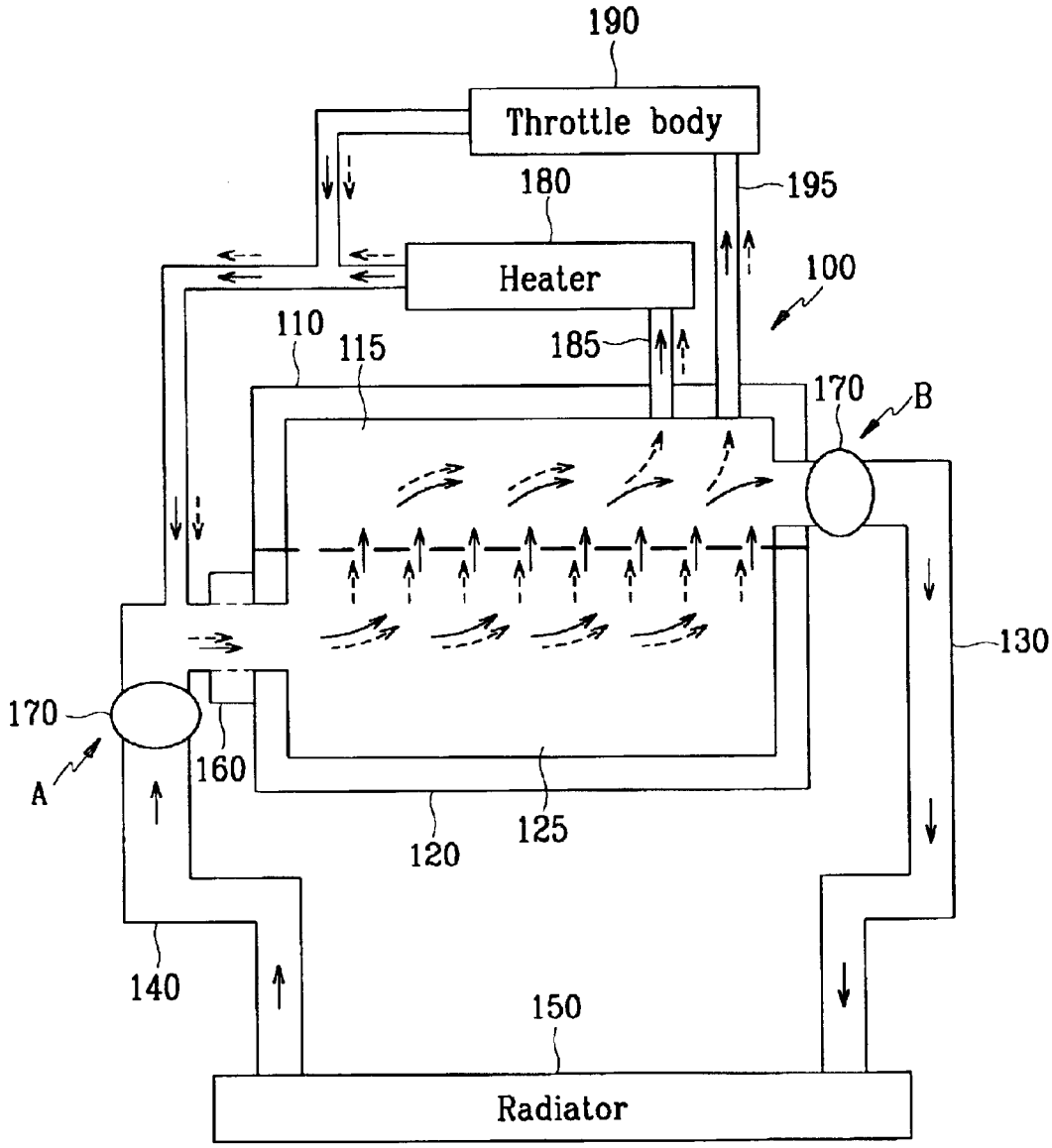
FIG.1 (PRIOR ART)
FIG. 1 is a schematic view of a conventional water-cooled cooling system of an engine, according to the prior art.
Figure 9:
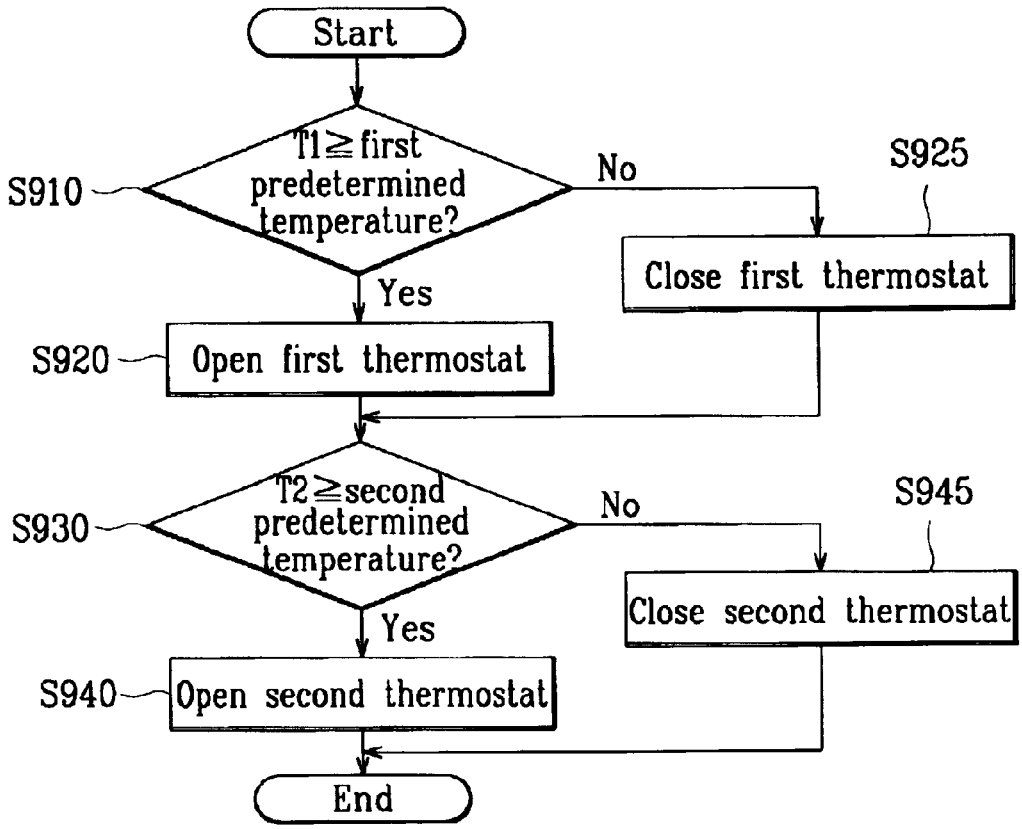
FIG. 9 is a flowchart showing a preferred embodiment of a cooling method of the present invention.

With reference to FIG. 9, a preferred embodiment of the engine cooling method can be realized by any of the above described embodiments of engine cooling systems. For ease of explanation, the method will be described with reference to FIG. 1.

First, it is determined if the coolant temperature T1 in the head water-jacket 215 is above a first predetermined temperature at step S910. When the coolant temperature T1 is above the first predetermined temperature (S910—Yes), the coolant in the head water-jacket 215 is supplied to the radiator 260 at step 920. When the coolant temperature T1 is not above the first predetermined temperature (S910—No), coolant supplied from the head water-jacket 215 to the radiator 260 is blocked at step S925. Determining if the coolant temperature T1 in the head water-jacket 215 is above a first predetermined temperature is performed at the first thermostat 280. Supplying or not supplying the coolant in the head water-jacket 215 to the radiator 260 is realized by whether the first thermostat 280 is open or closed.

Subsequently, it is determined if the coolant temperature T2 in the block water-jacket 225 is above a second predetermined temperature at step S930. When the coolant temperature T2 is above the second predetermined temperature (S930—Yes), then the coolant in the block water-jacket 225 is supplied to the radiator 260 at step S940, such that the coolant in the cylinder block 220 is cooled. When the coolant temperature in the block water-jacket 225 is not above the second predetermined temperature (S930—No), then the coolant in the block water-jacket 225 is supplied to the radiator 260 at step S945 by a smaller amount than in the step S940. Determining if the coolant temperature T2 in the block water-jacket 225 is above a second predetermined temperature is performed at the second thermostat 275. Supplying or not supplying the coolant in the block water-jacket 225 to the radiator 260 is realized by whether the second thermostat 275 is open or closed. The step S945 is realized by the passing holes 520 formed at the second thermostat 275.

The second predetermined temperature is preferably preset higher than the first predetermined temperature such that the temperature of the cylinder block 220 can be maintained relatively high when the engine load is not high because only the coolant in the head water-jacket 215 is supplied to and cooled at the radiator 260.

The first and second predetermined temperatures may depend on the type of materials used in the engine 200, however, for example, the first predetermined temperature may be chosen from a range of 82° C. to 88° C. and the second predetermined temperature may be chosen from a range of 95° C. to 105° C.

The following Table 1 shows states of the first and second thermostats 280 and 275 depending on the engine states after starting the engine 200. Coolant flows for each engine state are shown as dotted and solid arrows in FIGS. 2, 7, and 8.

TABLE 1

States of thermostats and coolant flow according to engine states

| | The first thermostat | The second thermostat | Coolant flow |
|---|---|---|---|
| When the engine is cool | Closed | Closed | Dotted arrows |
| Low temperature/load | Open | Closed | Dotted arrows + Solid arrows (except block water-jacket) |
| High temperature/load | Open | Open | Dotted arrows + Solid arrows |

When the engine 200 is warming up after being started, the first and second thermostats 280 and 275 are both closed, and accordingly the coolant flow in the cylinder block 220 is minimized. Therefore, the cylinder block 220 reaches a normal operating temperature rapidly, and the warm-up period is shortened.

However, when the cylinder head 210 is sufficiently heated such that the coolant temperature in the head water-jacket 215 becomes higher than the first predetermined temperature, the first thermostat 280 is opened. In this case also, flow of the coolant in the cylinder block 220 is blocked by the second thermostat 275. Therefore, when the engine load is low such as in the case of idling, only the first thermostat 280 is open and the coolant in the head water-jacket 215 circulates to and is cooled at the radiator 260. Therefore, even when the engine load is low, interior walls of the cylinder block 220 are maintained at a preferably high temperature. Accordingly, lubricant viscosity is low. As a result, friction is reduced and accordingly fuel consumption is also reduced. Furthermore, only sufficiently hot coolant is supplied to the radiator 260 and accordingly cooling efficiency is increased.

When the engine load is high, such as in the case of full-throttle, the engine generates a substantial amount of heat such that the coolant temperature in the block water-jacket 225 becomes higher than the second predetermined temperature, and accordingly the second thermostat 275 is opened. Therefore, the coolant in the cylinder block 220 as well as that in the cylinder head 210 is supplied to and cooled at the radiator 260.

Figure 10:
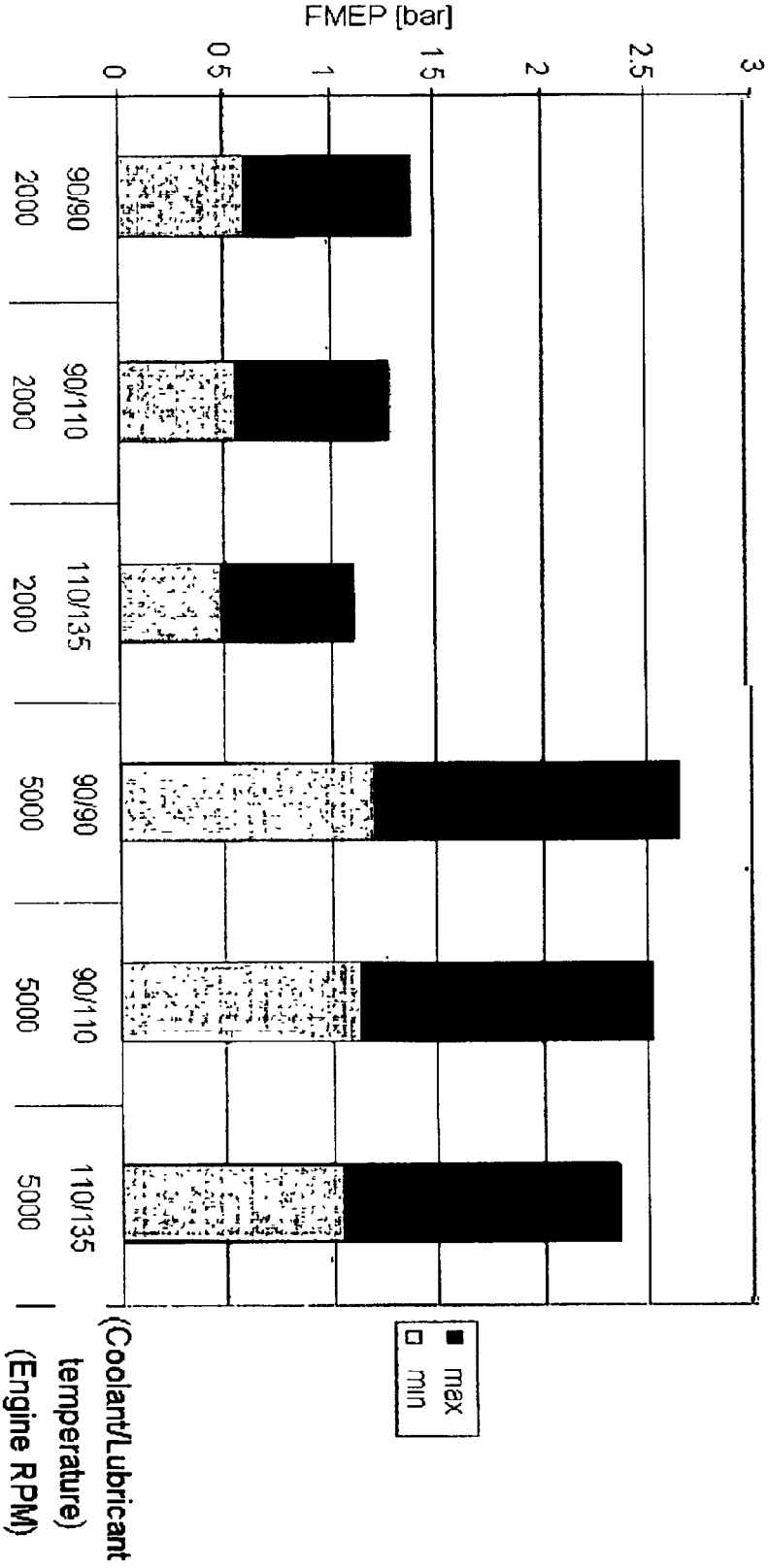
FIG. 10 is a graph showing effects according to a preferred embodiment of the present invention.

FIG. 10 shows effects of the present invention, where the horizontal axis denotes coolant temperatures and lubricant temperatures at particular engine speeds of 2,000 rpm and 5,000 rpm, and the vertical axis denotes Friction Mean Effective Pressure (FMEP) as it occurs at each of the engine states of the horizontal axis. The FMEP signifies the amount of combustion pressure loss because of the friction of moving parts in an engine, measured in terms of mean-effective-pressure acting on a piston. Where an engine is running at a particular RPM, for example at 2,000 rpm or 5,000 rpm, FMEP is reduced when the lubricant temperature is increased from 90° C. to 110° C., even at the same coolant temperature of 90° C. More specifically, comparing the case in which the coolant and lubricant temperatures are respectively 90° C. and 110° C. with the case in which the coolant and lubricant temperatures are respectively 110° C. and 135° C., the FMEP of the latter is shown to be reduced to as much as 0.1 bar less than the former, which means an increase of fuel-mileage of 3~4% for a common vehicle.

Therefore, according to this invention whereby a cylinder head and a cylinder block can be separately cooled, cooling efficiency is increased and all parts exposed to combustion heat can have a more optimal operating temperature. Furthermore, each of the coolant flowing in the cylinder head and the cylinder block is controlled based on engine load, and accordingly the engine operating temperature is more easily controlled. Furthermore, friction of the engine is reduced and accordingly fuel consumption is also reduced, because the coolant in the cylinder block can be maintained at a preferred temperature.

Even when the engine has not warmed up, because unnecessary coolant flow in the cylinder block is prevented, the warm-up period is reduced. Accordingly, fuel consumption for warming up the engine is reduced, and accordingly a catalytic converter is heated more rapidly such that noxious gasses (especially HC) are reduced during warm-up of an engine.

Furthermore, a heater in the interior of the vehicle is supplied with hot coolant more rapidly such that heating efficiency of the interior of the vehicle is increased. In addition, when the engine is driven under a high load, more coolant circulates through the cylinder head than the cylinder block. This prevents overheating of the cylinder head and accordingly prevents knocking of the engine. The engine power is also increased due to the efficiency of the engine is increased due to the lower cylinder head temperature.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A cooling system of an engine including a cylinder head and a cylinder block, the cylinder head having a head water-jacket for circulating coolant and the cylinder block having a block water-jacket for circulating coolant, the cooling system comprising:

a radiator for cooling the coolant;

a high-temperature coolant line for supplying the coolant from the head water-jacket to the radiator;

a low-temperature coolant line for supplying the coolant from the radiator to at least one of the head and block water-jackets;

a first thermostat disposed at a predetermined position in one of the low-temperature coolant line and the high-temperature coolant line;

a branch coolant line for supplying the coolant from the block water-jacket to the high-temperature coolant line;

a second thermostat disposed in the branch coolant line; and a hydraulic pump for generating coolant flow in the high-temperature and low-temperature coolant lines, wherein the head and block water-jackets communicate with each other by a primary pathway for transporting the coolant therebetween, and coolant flow is blocked within a cylinder-region, the cylinder region being defined as a region between the primary pathway and the branch coolant line.

2. The cooling system of claim 1, wherein a flow-rate of the second thermostat is smaller than a flow-rate of the first thermostat by a predetermined ratio.

3. The cooling system of claim 2, wherein the predetermined ratio is preset such that the ratio of coolant flow passing through the head water-jacket and the block water-jacket lies within a range of 7:3 to 5:5.

4. The cooling system of claim 1, wherein the primary pathway is formed near a circumference of a cylinder distal from where the coolant is exhausted from the head water-jacket to the high-temperature coolant line.

5. The cooling system of claim 4, wherein, within the cylinder-region, at least one air hole is formed between the head water-jacket and the block water-jacket.

6. The cooling system of claim 4, wherein a secondary pathway for transporting the coolant between the block and head water-jackets is further formed therebetween, at a more distal portion from where the coolant is exhausted from the head water-jacket to the high-temperature coolant line than the primary pathway.

7. The cooling system of claim 1, wherein the first thermostat is disposed at the high-temperature coolant line, and the branch coolant line connects the block water-jacket to the high-temperature coolant line at a predetermined portion between the head water-jacket and the first thermostat.

8. The cooling system of claim 1, wherein a bypass flow-line for bypassing the second thermostat is formed at at least one of the branch coolant line and the second thermostat.

9. The cooling system of claim 1, wherein:

the low-temperature coolant line is connected to the branch coolant line, such that the low-temperature coolant line comprises a first low-temperature coolant line from the radiator to the branch coolant line and a second low-temperature coolant line from the branch coolant line to the hydraulic-pump;

the first thermostat, disposed between the first low-temperature coolant line and the branch coolant line, comprises a main valve and a bypass valve, the main and bypass valves being cooperatively connected; and the second low-temperature coolant line is branched between the main valve and the bypass valve.

10. The cooling system of claim 1, wherein the low-temperature coolant line supplies the coolant to the block water-jacket.

11. A cooling method of an engine including a cylinder head and a cylinder block, the cylinder head having a head water-jacket for circulating coolant and the cylinder block having a block water-jacket for circulating the coolant, the cooling method comprising:

determining if a coolant temperature in the head water-jacket is above a first predetermined temperature;

supplying the coolant in the head water-jacket to a radiator when the coolant temperature in the head water-jacket is above the first predetermined temperature;

determining if a coolant temperature in the block water-jacket is above a second predetermined temperature; and supplying the coolant in the block water-jacket to a radiator when the coolant temperature in the block water-jacket is above the second predetermined temperature; and supplying the coolant in the block water-jacket to the radiator, when the coolant temperature in the block water-jacket is not above the second predetermined temperature, in a smaller amount than in said supplying the coolant in the block water-jacket to a radiator.

12. The cooling method of claim 11, wherein the second predetermined temperature is higher than the first predetermined temperature.

* * * * *